US006059370A

United States Patent [19]

Kanyer et al.

[11] Patent Number: 6,059,370

[45] Date of Patent: May 9, 2000

[54] WHEELCHAIR SEAT BACK PELVIC SUPPORT SYSTEM

[75] Inventors: Brian D. Kanyer, Michigan City, Ind.; James L. Christofferson, Longmont, Colo.; Vincent J. Frerich, Arvada, Colo.; Grant C. Denton, Boulder, Colo.

[73] Assignee: Sunrise Medical HHG Inc., Longmont, Colo.

[21] Appl. No.: 09/156,156

[22] Filed: Sep. 17, 1998

Related U.S. Application Data

[60] Provisional application No. 60/059,377, Sep. 19, 1997.

[51] Int. Cl.[7] ..... A47C 7/40

[52] U.S. Cl. ..... 297/452.36; 297/230.13; 297/284.4; 297/284.9

[58] Field of Search ..... 297/230.12, 230.13, 297/230.14, 284.4, 284.9, 452.35, 452.36; 5/630, 631, 632, 628, 653

[56] References Cited

U.S. PATENT DOCUMENTS

| | | | |
|---|---|---|---|
| 4,753,482 | 6/1988 | Warren | 297/452.35 X |
| 5,131,410 | 7/1992 | Neill et al. | 5/657 |
| 5,149,173 | 9/1992 | Jay et al. | 297/DIG. 6 X |
| 5,352,023 | 10/1994 | Jay et al. | 297/452.21 |
| 5,407,248 | 4/1995 | Jay et al. | 297/284.1 |
| 5,564,788 | 10/1996 | Warhaftig | 297/452.36 X |
| 5,647,637 | 7/1997 | Jay et al. | 297/354.12 |

FOREIGN PATENT DOCUMENTS

| | | | |
|---|---|---|---|
| 759358 | 5/1967 | Canada | 297/452.35 |

OTHER PUBLICATIONS

The Aftermarket Group, Rehab Seating & Positioning Products 1997–1998, p. 23.

*Primary Examiner*—Peter R. Brown

*Attorney, Agent, or Firm*—MacMillan, Sobanski & Todd, LLC

[57] ABSTRACT

A support system for use with a wheelchair seat back provides support for the pelvic area of a wheelchair occupant. The support system comprises a base plate mountable to a wheelchair seat back, and a base layer adhered to the based plate. The base plate is dimensioned and configured to substantially span and conform to the wheelchair seat back. A front surface of the base layer comprises a fastening element for mounting additional layers, or pelvis-conforming blocks, to the base layer.

26 Claims, 6 Drawing Sheets

WHEELCHAIR SEAT BACK PELVIC SUPPORT SYSTEM

CROSS-REFERENCE TO RELATED APPLICATIONS

This application claims the benefit of U.S. Provisional Application No. 60/059,377, filed on Sep. 19, 1997.

TECHNICAL FIELD

This invention relates in general to wheelchairs, and in particular to cushioning and support mechanisms suitable for maintaining a wheelchair occupant in proper position. More particularly, this invention pertains to wheelchair cushioning and support mechanisms for enabling a wheelchair to be adjusted to fit the requirements, including the size and shape, of the wheelchair occupant.

BACKGROUND OF THE INVENTION

A significant number of people confined to wheelchairs have body deformities that require a customized back support. These wheelchair occupants require a back support that conforms to the shape of their bodies so that they will have enough contact with the back support to be able to sit upright, without falling over. A custom shaped back support also provides comfort and avoids skin pressure that may result in ducubitus ulcers or other skin problems.

Numerous other wheelchair occupants, while not necessarily needing a wheelchair particularly adapted for handling bodily deformities, require and desire wheelchairs having proper trunk control for good posture and for comfort.

In order to properly fit wheelchair occupants, the backs of the wheelchair are preferably contoured to be able to fit closely to the occupant's body shape to provide support over the occupant's whole back without putting too much pressure on any one point. One approach to achieving this goal is to provide a customized foam cushion, formed in place to fit the wheelchair occupant's back. Another approach is to carve a foam blank to the shape of the occupant's back. Each of these approaches is somewhat deficient because there is no way to change the shape of the foam cushion to accommodate the changing needs of the wheelchair occupant, or to correct errors in the initial shape of the cushion.

Another approach to the problem of properly and easily fitting the foam cushion to meet the needs of the wheelchair occupant is to provide an adjustable hard matrix of metal parts, aligned and adjusted to generally conform to the shape of the occupant's back. The hard metal matrix is then covered by foam and a fabric cover. A disadvantage of this system is that several hours of tedious adjustment are required to properly fit the matrix to the shape of the occupant's back.

Yet another approach to fitting the wheelchair back to the occupant is disclosed in U.S. Pat. No. 5,407,248, issued to Eric C. Jay et al., which is hereby incorporated by reference in its entirety. A rigid back shell extends between the vertical posts of the wheelchair. A padding system consisting of a contoured foam pad is attached to the rigid shell, and fluid-filled pads can be used for cushioning sensitive areas of the occupant's back, such as the spinal area. Further, U.S. Pat. No. 5,407,248 discloses the use of foam blocks removably attached to the seat back by means of hook and loop fasteners, whereby the foam blocks can be removed as needed to form recessed areas generally conforming to the contour of the occupant's back. Further, foam transition blocks can be used to smooth out the contour defined by the foam blocks and the recessed areas. Also, built-up pads can be applied, using hook and loop fasteners, to the front of the foam blocks, or to the seat back in the recessed areas, to further customize the fit of the wheelchair. The support system of U.S. Pat. No. 5,407,248 provides numerous advantages to the wheelchair occupant, particularly in the area of comfort for the mid and upper back regions of the occupant's back. It would be advantageous if there could be developed a support system providing even greater support for wheelchair occupants.

SUMMARY OF THE INVENTION

The present invention is a support system for use with a wheelchair seat back to provide support for the pelvic area of a wheelchair occupant. The support system comprises a base plate mountable to a wheelchair seat back, and a base layer adhered to the based plate. The base plate is dimensioned and configured to substantially span and conform to the wheelchair seat back. A front surface of the base layer comprises a fastening element for mounting additional layers, or pelvis-conforming blocks, to the base layer.

DETAILED DESCRIPTION OF THE INVENTION

Figure 1:
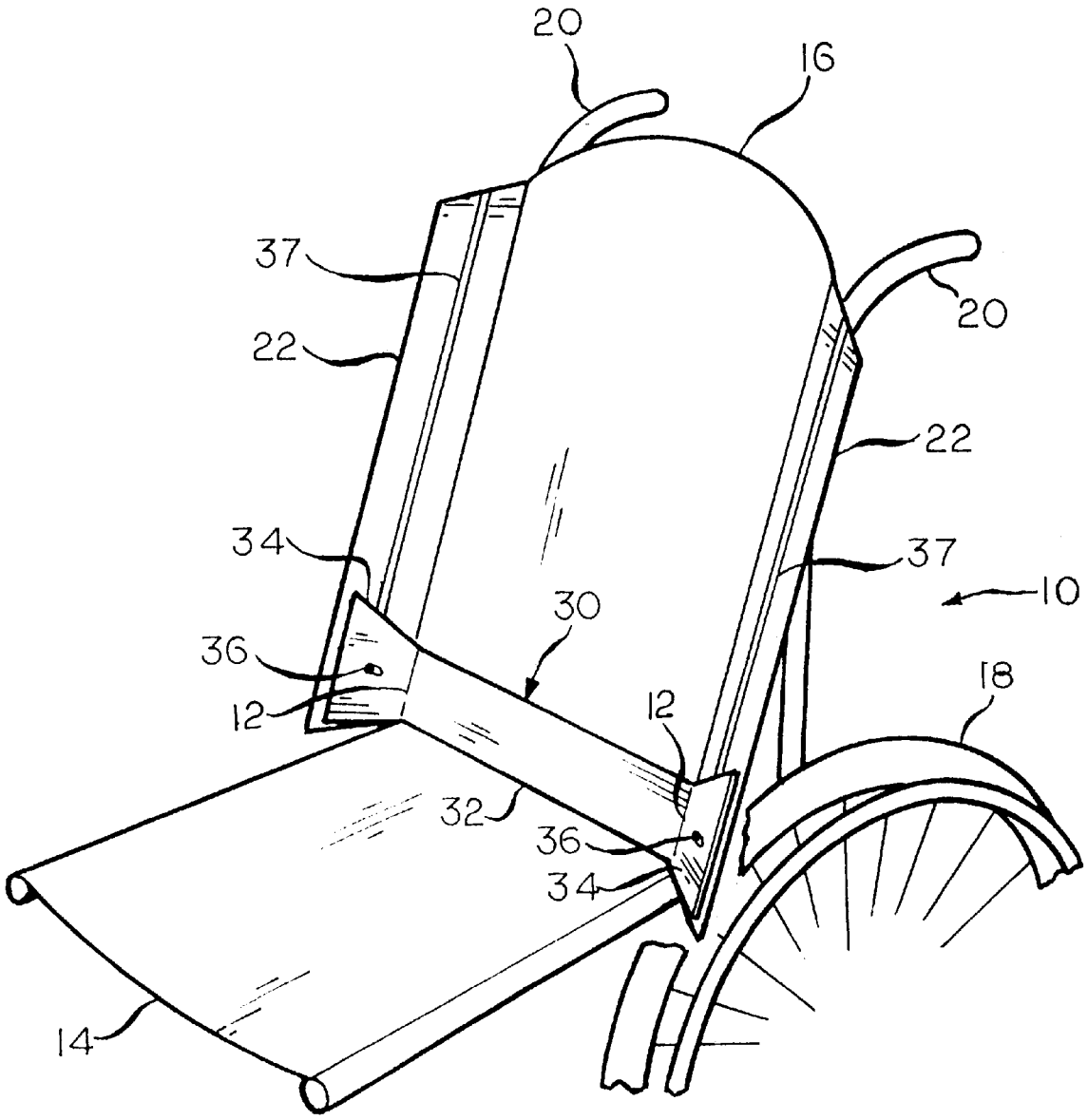
FIG. 1 is a partial schematic view in perspective of a wheelchair having a base plate for a pelvic support system of the invention.

As shown in FIG. 1, wheelchair is indicated generally at 10. The wheelchair 10 includes a seat 14 and a seat back 16. The frame (not shown) provides a mounting for the seat 14, the seat back 16, caster wheels (not shown) and the rear wheels 18. The wheelchair 10 can optionally be provided with armrests (not shown) and push handles 20.

The wheelchair 10 is provided with optional side extrusions or side wings 22 suitable for providing lateral support for the upper body of the wheelchair occupant. Mounted at the lower end of the seat back 16 is the base plate 30 of an adjustable pelvic support system 60 of the invention. The base plate 30 is formed with two spaced apart angles 12 defining two oppositely disposed support wings 34 and a central base portion 32 between the two spaced apart angles 12 and the two support wings 34. The base plate 30 is preferably shaped to substantially conform to the wheelchair seat back 16. The base plate 30 can be attached to the seat back 16 by any suitable means, such as by bolts 36 attaching the support wings 34 to the side wings 22 of the wheelchair 10. The side wings 22 of the wheelchair 10 preferably have slots or multiple threaded holes 21 (shown in FIG. 2) for receiving the bolts 36 to allow a height adjustment of the base plate 30 for a proper fit with the pelvis of the occupant. Most preferably, the side wings 22 are provided with a continuous slot or track 37 to allow infinite adjustment of the base plate 30.

Figure 2:
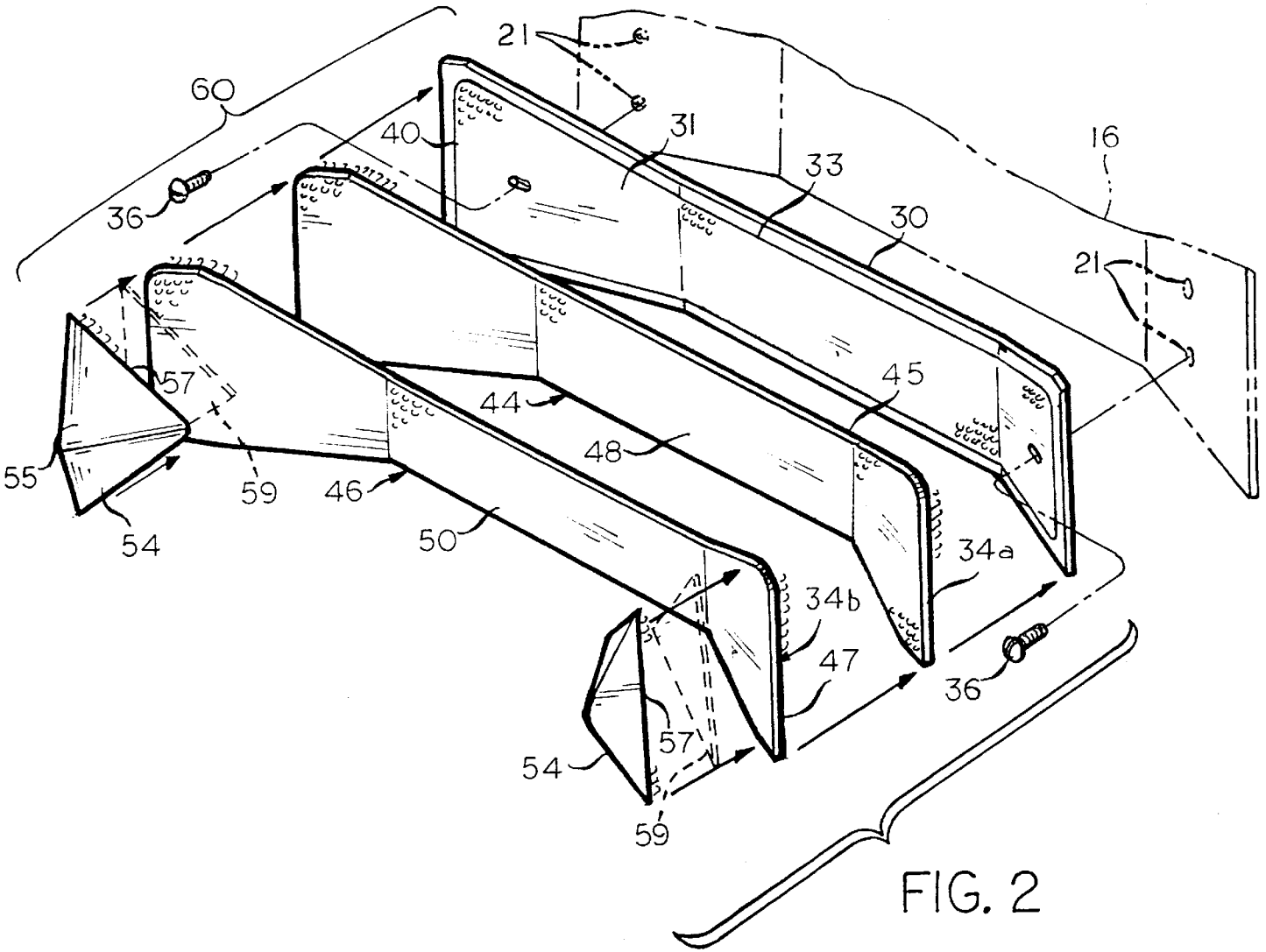
FIG. 2 is an exploded schematic view in perspective of the pelvic support system of the invention and a wheelchair seat back upon which the pelvic support system may attached.
Figure 3:
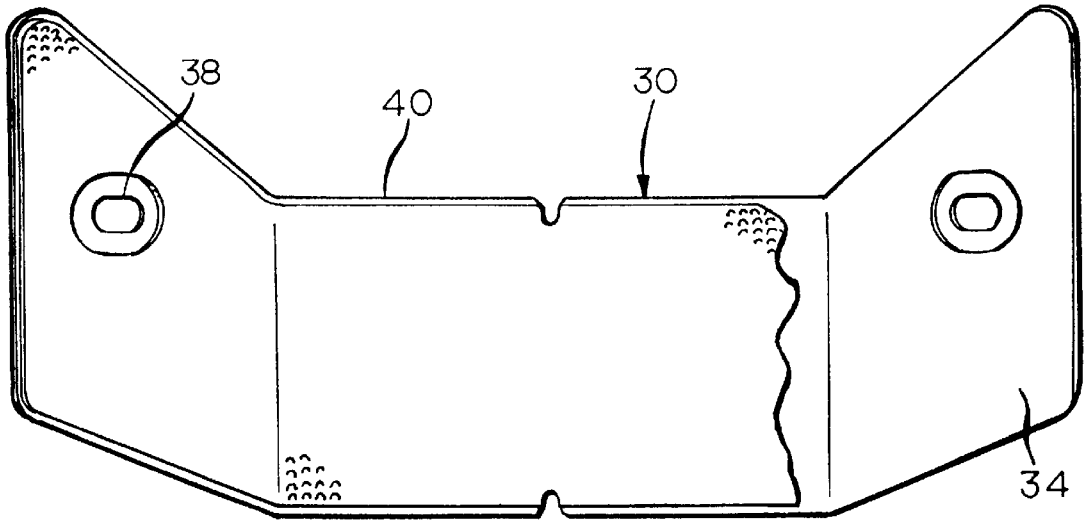
FIG. 3 is a view in elevation of the base plate for the pelvic support system of FIG. 2.
Figure 4:
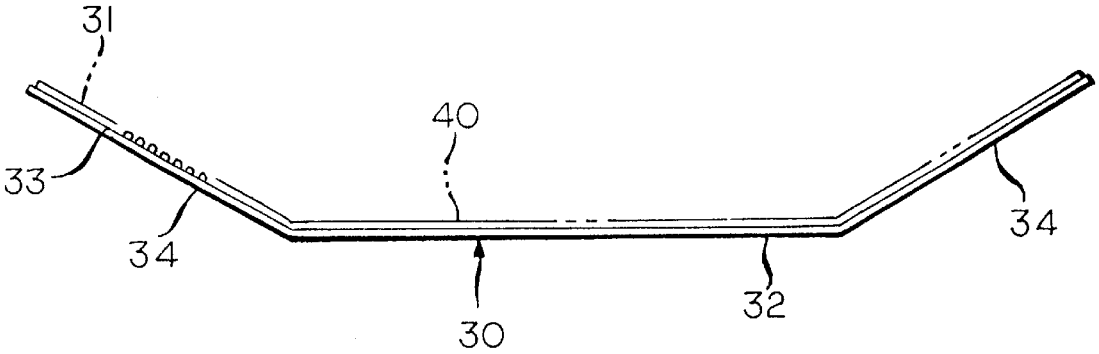
FIG. 4 is a top view of the base plate of FIG. 3.

With reference to FIGS. 2–4, the base plate 30 shown includes a front surface and a back surface. The base plate 30 is mounted to the lower end of the wheelchair seat back 16 with the back surface of the base plate 30 situated juxtaposed the wheelchair seat back 16. The base plate 30 is provided with bolt holes 38 for receiving bolts 36 for attaching the support wings 34 to the side wings 22 of the wheelchair 10. A base layer 40 is attached to the base plate 30. The base layer 40 has a front surface 31 and a back surface 33 and is shaped to substantially cover the entire front surface 31 of the base plate 30 (shown more clearly in FIG. 4). The back surface 33 of the base layer 40 is adhered to the front surface of the base plate 30. The front surface 31 of the base layer 40 comprises a front fastening element (i.e., either a layer of hook fabric or a layer of loop fabric). Preferably, the base layer 40 is a loop fabric, which is adhered to the front surface of the base plate 30, using an adhesive.

Double sided intermediate and outer hook and loop fabric layers 44 and 46 generally conform to the shape of the base plate 30 so that they can be attached and held in place. The fabric layers 44 and 46 each have a front surface 48 and 50 and a back surface 45 and 47. The back surfaces 45 and 47 preferably comprise a back fastening element and the front surfaces 48 and 50 preferably comprise a front fastening element. The back fastening elements are preferably a hook portion of a hook and loop-type fastener and the front fastening elements are preferably a loop portion of a hook and loop-type fastener. The back hook surface 45 of the intermediate fabric layer 44 is matingly engageable with the front loop surface 31 of the base layer fabric 40 and the back hook surface 47 of the outer fabric layer 46 is matingly engageable with the front loop surface 48 of the intermediate fabric layer 44. The base layer 40 as well as the intermediate and outer layers 44 and 46 are preferably of different thicknesses to allow adjustment of the pelvic support system 60 to accommodate the support needs of the wheelchair occupant. Although intermediate and outer fabric layers 44 and 46 are shown, it is to be understood that the requirements of different wheelchair occupants might dictate using anywhere from zero up to four or more fabric layers similar to the layers 44 and 46 to meet the needs of the wheelchair occupant. It can be seen that the use of hook and loop fastening system allows changes in the pelvic support system to be made easily.

Secured on the pelvic support system 60 are pelvis-conforming blocks 54, which can take any shape suitable for conforming to the general shape of the pelvis of the occupant. The pelvis-conforming blocks 54 can be attached to the support wings 34 of the base plate 30, or to the support wings 34*a* or 34*b* of the intermediate or outer fabric layers 44 or 46, as shown. The pelvis-conforming blocks 54 can have the shape of polyhedrons, such as, for example, wedges or pyramids. The pelvis-conforming blocks 54 can be comprised of foam, and can be covered with a fabric material 55. Other materials can be used also, with the primary function of the blocks 54 being to take up the space so that a shape closely conforming to the pelvis of the wheelchair occupant can be made. The pelvis-conforming blocks 54 are preferably provided with a hook surface of a hook and loop system 57 so that the blocks 54 can be adhered to the loop surface 50 of the outer fabric layer 46. Other methods of attachment, such as pressure sensitive adhesive 59, can be used. It should be understood that the invention may be comprised of extra pelvis-conforming blocks 54, if necessary, to conform to the general shape of the pelvis of the occupant.

Figure 5:
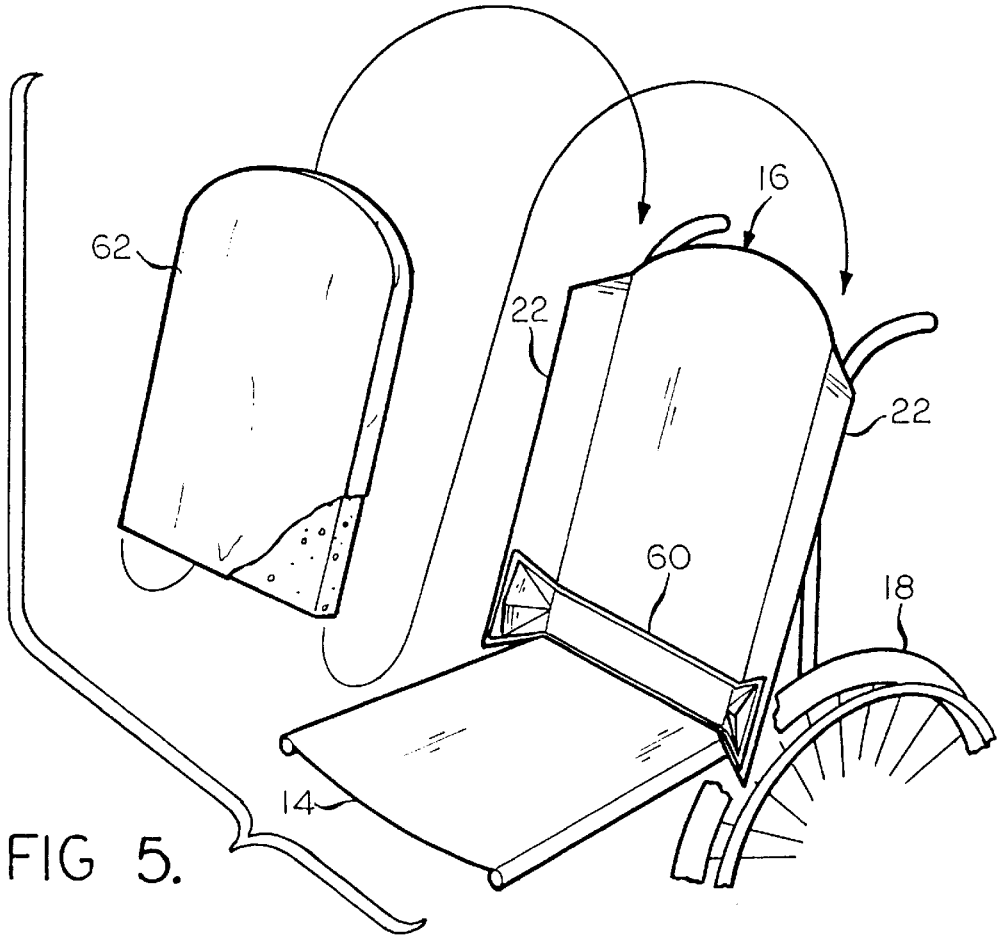
FIG. 5 is a schematic view in perspective of a wheelchair assembly having a cushion suitable for use with the pelvic support system illustrated in FIGS. 1–4.
Figure 6:
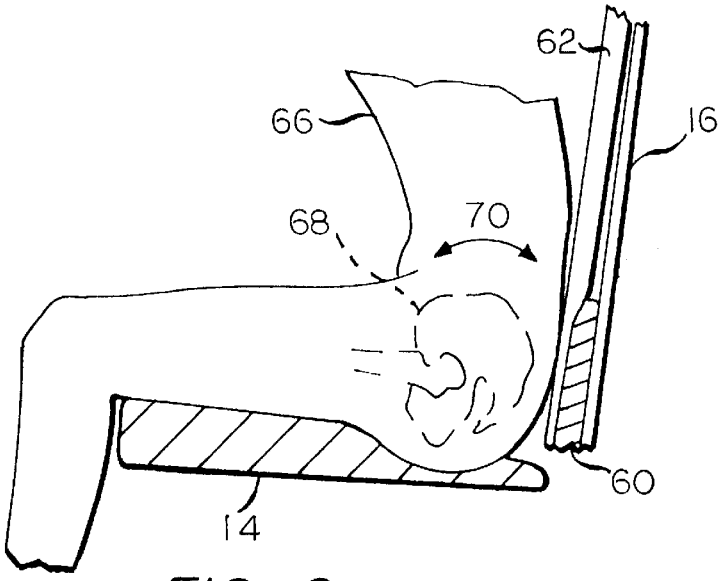
FIG. 6 is a schematic cross-sectional view in elevation illustrating the relationship of the pelvic support system of the invention to the pelvis of a wheelchair occupant.

As shown in FIG. 5, after the entire pelvic support system 60 of the invention is installed on the seat back 16, a fabric covered foam pad 62 can be installed onto the seat back 16 to complete the construction of the seat back 16. As shown in FIG. 6, when the wheelchair occupant, indicated at 66, is seated in the wheelchair 10, the pelvis 68 of the occupant 66 is generally vertically in line with the pelvic support system 60. Without the proper support provided by the pelvic support system 60, the pelvis 68 of the occupant 66 can pivot forward, in the anterior direction, or rearward in the posterior direction, as indicated by the arrow 70. In some cases, the pelvis-conforming blocks 54 are configured or aligned to be slightly above or superior to the pelvis 68 to help provide support for the pelvis. The exact configuration of the blocks 54 will vary from occupant to occupant, and the adaptability of the pelvic support system of the invention provides the flexibility needed to fit any wheelchair occupant.

Figure 7:
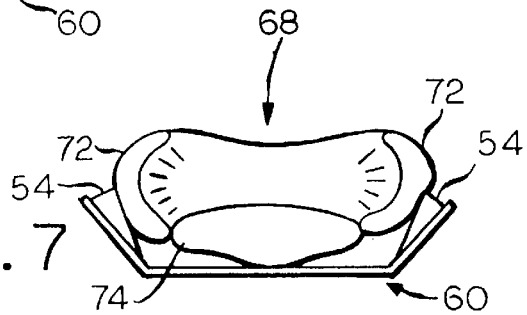
FIG. 7 is a schematic top view of the pelvis of the wheelchair occupant of FIG. 6.

FIG. 7 illustrates that the pelvis 68 consists in part of the side or iliac portions 72 and the rear or sacral area 74. For purposes of clarity, the foam pad 62 is not shown. The base plate 30 and the fabric layers 44 and 46 (shown in FIG. 2), coupled with the pelvis-conforming blocks 54 (also shown in FIG. 2) wrap around the pelvis and provide the support necessary for maintaining the occupant in the correct orthopedic position in the wheelchair 10 (shown in FIGS. 1 and 5). Without proper support provided by the pelvic support system 60, the pelvis 68 of the occupant can tilt laterally, with one or the other of the iliac portions 72 tilting upward or downward.

Figure 8:
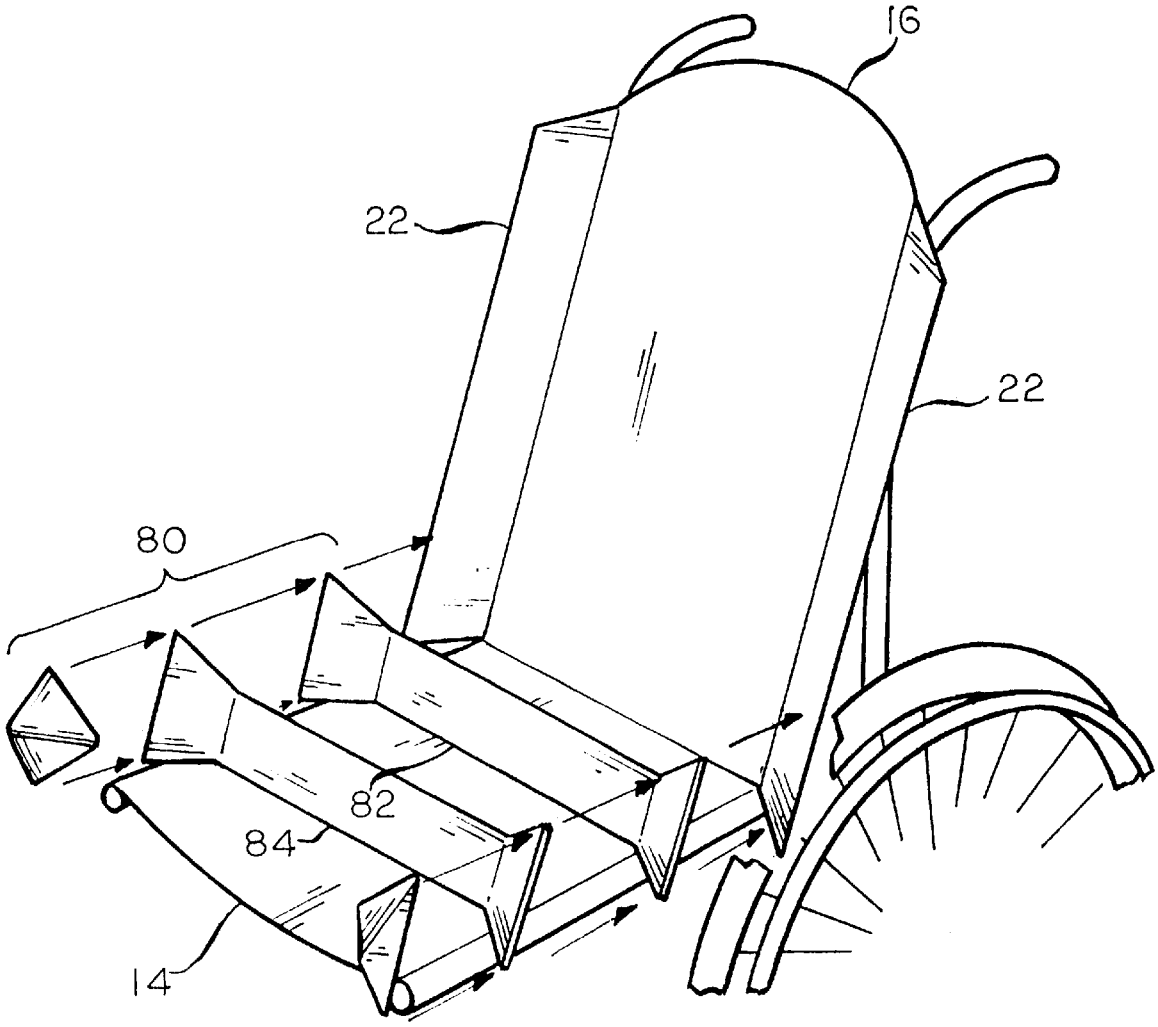
FIG. 8 is a schematic view in perspective of another embodiment of the wheelchair of the invention, with the pelvic support system in an exploded view, where the pelvic support system of the invention is formed without the base plate.

As shown in FIG. 8, in an alternate embodiment of the invention, the pelvic support system 80 is comprised of fabric layers 82 and 84 similar to the fabric layers 44 and 46 illustrated in FIG. 5. In a similar manner, fabric layers 82 and 84 have loop front surfaces and hook rear surfaces. The fabric layer 82 is adhered to the wheelchair seat back 16 and side wings 22 in some suitable manner. Preferably an additional layer of loop fabric (not shown for purposes of clarity), similar to base loop fabric 40, is adhered to the seat back 16 and side wings 22. The pelvic support system 80 does not have a base plate like the base plate 30 of the pelvic support system 60 described above.

Figure 9:
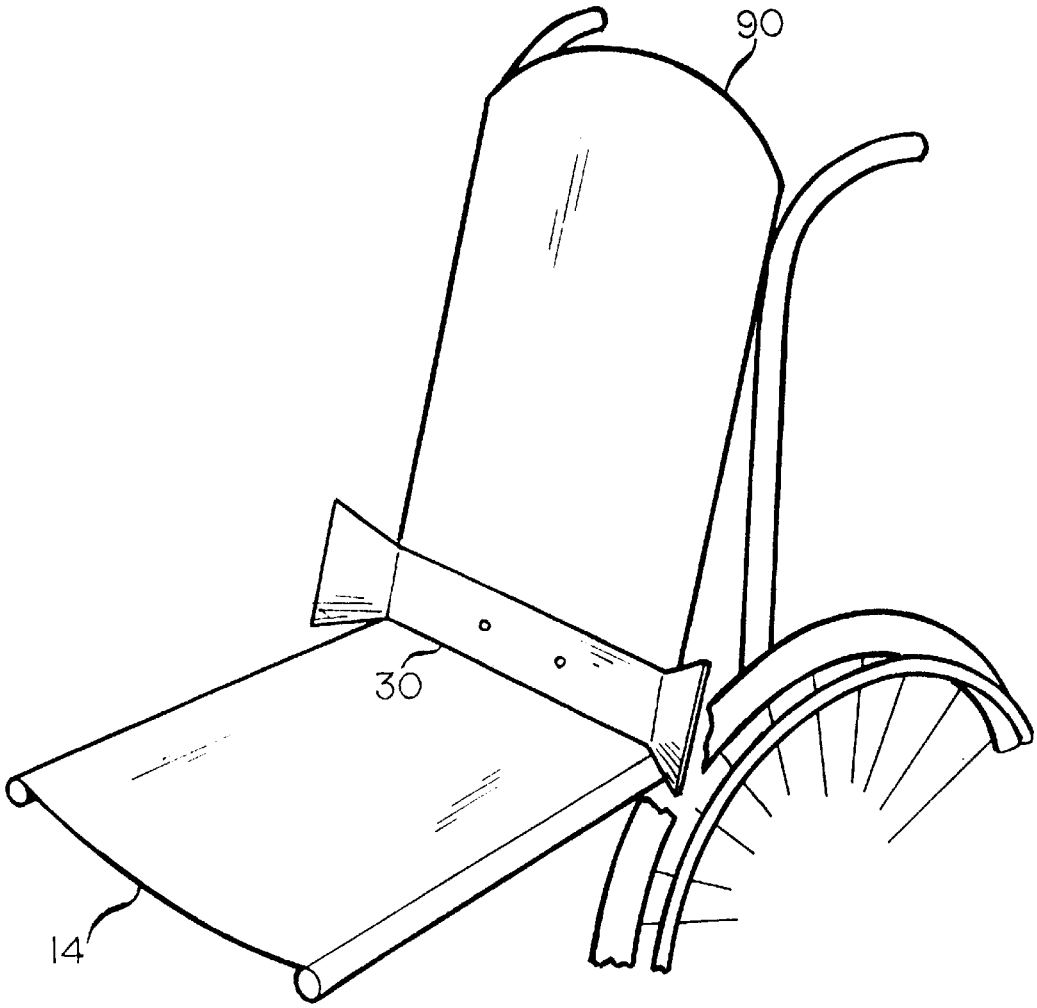
FIG. 9 is a schematic view in perspective of yet another embodiment of the wheelchair of the invention, where the seat back shell is formed without side wings.

As shown in FIG. 9, the pelvic support system of the invention can be configured using a base plate 30 on a seat back 90 having no side wings. The pelvic support system 60 can be built up on the base plate 30 in a manner similar to that described above with reference to FIGS. 1–7.

Figure 10:
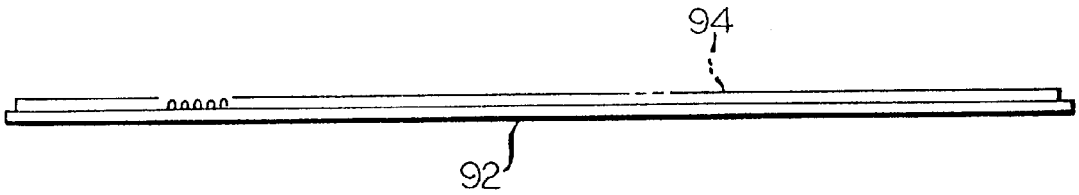
FIG. 10 is a top view, similar to the view shown in FIG. 4, of a planar base plate.

FIG. 10 illustrates a substantially straight or planar base plate 92 dimensioned to span the wheelchair seat back 16. The base plate has a base loop fabric 94 for the attachment of additional fabric layers (not shown) similar to fabric layers 44 and 46 described above. When using the planar base plate 92, extra pelvis-conforming blocks 54 are used to provide adequate support for the pelvis.

The principle and mode of operation of this invention have been described in its preferred embodiment. However, it should be noted that this invention may be practiced otherwise than as specifically illustrated and described without departing from the scope of the invention.

What is claimed is:

1. A support system for use with a wheelchair seat back for providing support for the pelvic area of a wheelchair occupant, said support system comprising:

a base plate adapted to be mounted to only a lower end of the wheelchair seat back, said base plate being shaped to substantially conform to the wheelchair seat back and is adapted to extend substantially across the width of the wheelchair seat back, said base plate having a front surface and a back surface, said back surface being situated juxtaposed the wheelchair seat back upon mounting said base plate to the wheelchair seat back; and a base layer having a front surface and a back surface, said back surface of said base layer being adhered to said front surface of said base plate, said base layer front surface comprising a front fastening element adapted to engage an outer layer.

2. A support system according to claim 1, wherein said outer layer has a front surface and a back surface, said back surface of said outer layer comprising a back fastening element, said back fastening element being engageable with said front fastening element of said base layer.

3. A support system according to claim 2, wherein said base layer and said outer layer are different thicknesses.

4. A support system according to claim 2, wherein said front fastening element of said base layer is a loop portion of a hook and loop-type fastener and said back fastening element of said outer layer is a hook portion of a hook and loop-type fastener.

5. A support system according to claim 2, wherein said base layer is shaped to substantially cover said entire front surface of said base plate.

6. A support system according to claim 1, wherein said base plate is formed with two spaced apart angles defining opposite support wings and a central base portion between said support wings.

7. An adjustable support system according to claim 6, further comprising:

a pelvis-conforming block secured to each one of said support wings, said pelvis-conforming blocks having a shape adapted to conform to the general shape of the pelvis of a wheelchair occupant.

8. An adjustable support system according to claim 7, wherein said pelvis-conforming blocks are wedge shaped.

9. An adjustable support system according to claim 7, wherein said pelvis-conforming blocks are pyramid shaped.

10. An adjustable support system according to claim 7, wherein said pelvis-conforming blocks are comprised of foam.

11. An adjustable support system according to claim 7, wherein said pelvis-conforming blocks are comprised of foam covered with a fabric material.

12. An adjustable support system according to claim 7, wherein said pelvis-conforming blocks have a back surface comprising a back fastening element, said back fastening element of said pelvis-conforming blocks being engageable with said support wings.

13. An adjustable support system according to claim 7, further comprising:

a pressure sensitive adhesive for securing said pelvis-conforming blocks to said support wings.

14. An adjustable support system according to claim 7, wherein said pelvis-conforming blocks are adapted to be disposed slightly above the pelvis of the wheelchair occupant.

15. An adjustable support system according to claim 7, further comprising:

extra pelvis-conforming blocks adapted to secured to be said pelvis-conforming block secured to each one of said support wings.

16. A support system according to claim 1, further comprising:

a fabric covered foam pad installed covering the seat back and said pelvic support system.

17. A support system according to claim 1, wherein said back plate is dimensioned and configured to provide support for a wheelchair occupant's pelvic area only.

18. A support system for use with a wheelchair seat back for providing support for the pelvic area of a wheelchair occupant, said support system comprising:

a base plate adapted to be mounted to only a lower end of the wheelchair seat back, said base plate being shaped to substantially conform to the wheelchair seat back and is adapted to extend substantially across the width of the wheelchair seat back, said base plate having a front surface and a back surface, said back surface being situated juxtaposed the wheelchair seat back upon mounting said base plate to the wheelchair seat back;

a base layer having a front surface and a back surface, said back surface of said base layer being adhered to said front surface of said base plate, said base layer front surface comprising a front fastening element; and an outer layer having a front surface and a back surface, said back surface of said outer layer comprising a back fastening element, said back fastening element being engageable with said front fastening element of said base layer.

19. A support system according to claim 18, further comprising:

at least one intermediate layer having a front surface and a back surface, said back surface of said intermediate layer comprising a back fastening element, said back fastening element of said intermediate layer being engageable with said front fastening element of said base layer, and said back fastening element of said outer layer being engageable with said front fastening element of said intermediate layer.

20. A support system according to claim 18, wherein said base plate is formed with two spaced apart angles defining opposite support wings and a central base portion between said support wings.

21. An adjustable support system according to claim 20, further comprising:

a pelvis-conforming block secured to each one of said support wings, said pelvis-conforming blocks having a shape suitable for conforming to the general shape of the pelvis of a wheelchair occupant.

22. An adjustable support system according to claim 20, wherein said pelvis-conforming blocks are configured to be disposed slightly above the pelvis of the wheelchair occupant.

23. A support system according to claim 18, further comprising:

a fabric covered foam pad installed covering the seat back and said pelvic support system.

24. A support system according to claim 18, wherein said base layer is shaped to substantially cover said entire front surface of said base plate.

25. A support system for use with a wheelchair seat back for supporting the pelvic area of a wheelchair occupant, the wheelchair seat back having side wings, said support system comprising:

a base fabric layer having a front surface and a back surface, said back surface of said base fabric layer being adapted to be mounted to only a lower end of the wheelchair seat back and is adapted to extend substantially across the width of the wheelchair seat back, said base fabric layer front surface comprising a front fastening element;

an intermediate fabric layer having a front surface and a back surface, said front surface of said intermediate fabric layer comprising a front fastening element and said back surface of said intermediate fabric layer comprising a back fastening element, said back fastening element of said intermediate fabric layer being engageable with said front fastening element of said base fabric layer; and an outer fabric layer having a front surface and a back surface, said front surface of said outer fabric layer comprising a front fastening element and said back surface of said outer fabric layer comprising a back fastening element, said back fastening element of said outer fabric layer being engageable with said front fastening element of said intermediate fabric layer.

26. A support system according to claim 25, wherein said base layer is shaped to substantially cover said entire front surface of said base plate.

* * * * *